US006615699B2

(12) United States Patent
Jäger

(10) Patent No.: US 6,615,699 B2
(45) Date of Patent: Sep. 9, 2003

(54) METHOD AND DEVICE FOR CUTTING CONTINUOUSLY CONVEYED, FLAT OBJECTS

(75) Inventor: Erich Jäger, Frauenfeld (CH)

(73) Assignee: Ferag AG, Hinwill (CH)

( * ) Notice: Subject to any disclaimer, the term of this patent is extended or adjusted under 35 U.S.C. 154(b) by 0 days.

(21) Appl. No.: 09/954,337

(22) Filed: Sep. 10, 2001

(65) Prior Publication Data

US 2002/0112579 A1 Aug. 22, 2002

Related U.S. Application Data

(63) Continuation of application No. 09/341,601, filed as application No. PCT/CH98/00031 on Jan. 28, 1998, now abandoned.

(51) Int. Cl.[7] ..... B26D 1/56; B26D 7/06; B26D 7/26

(52) U.S. Cl. ..... 83/37; 83/303; 83/311; 83/321; 83/934; 83/312

(58) Field of Search ..... 83/37, 38, 934, 83/311, 399, 303, 13, 321, 312

(56) References Cited

U.S. PATENT DOCUMENTS

| | | | | |
|---|---|---|---|---|
| 3,069,952 A | | 12/1962 | Roksvaag | |
| 3,822,626 A | * | 7/1974 | Aspinwall | 83/934 X |
| 4,480,518 A | * | 11/1984 | Futterer | 83/349 X |
| 5,113,731 A | * | 5/1992 | Reist | 83/934 X |
| 5,503,051 A | * | 4/1996 | Stauber | 83/349 X |
| 5,715,737 A | * | 2/1998 | Stauber et al. | 83/934 X |
| 5,809,856 A | * | 9/1998 | Reist et al. | 83/934 X |
| 5,832,799 A | * | 11/1998 | Luthi et al. | 83/934 X |
| 5,924,346 A | * | 7/1999 | Wunderlich et al. | 83/37 |
| 6,012,367 A | * | 1/2000 | Westra et al. | 83/934 X |

FOREIGN PATENT DOCUMENTS

| | | |
|---|---|---|
| DE | 12 58 826 B | 1/1968 |
| DE | 25 17 121 A | 10/1976 |
| EP | 0 367 715 A | 5/1990 |
| EP | 0 698 451 A1 | 2/1996 |
| GB | 932 281 A | 6/1963 |

* cited by examiner

*Primary Examiner*—Charles Goodman
(74) *Attorney, Agent, or Firm*—Oppedahl & Larson LLP

(57) ABSTRACT

The described method serves for trimming or cutting during conveyance in a conveying direction (F) substantially in parallel to their main surfaces, flat objects along predetermined cutting lines parallel to the conveying direction (F). The objects are conveyed between a first and a second cutting edge ($SK_1$ and $SK_2$) and are cut by a relative movement of the two cutting edges. The first cutting edge ($SK_1$) is positioned, e.g. stationary, in the plane of a support surface supporting the objects and for each cutting process, the second cutting edge ($SK_2$) is moved past the first cutting edge in such a manner that at least the cutting point on the second cutting edge has a speed component in conveying direction (F) which has the same size as the conveying direction and a speed component perpendicular to the support surface. This is advantageously realized by a swiveling or rotating movement of the second cutting edge ($SK_2$) around a rotation axis (M) arranged above the support surface, whereby for fulfilling the above condition, the distance (y) of the rotation axis from the support surface and the rotation speed (ω) are correspondingly matched. Advantageously, a plurality of second cutting edges ($SK_2$) are arranged in a star-shaped manner in a plane perpendicular to the rotation axis (M) and the arrangement of second cutting edges ($SK_2$) is rotated around the rotation axis at a constant speed (ω).

14 Claims, 7 Drawing Sheets

$$\omega = \frac{v_G}{d \cdot n} \qquad y = \frac{d \cdot n}{2\pi}$$

METHOD AND DEVICE FOR CUTTING CONTINUOUSLY CONVEYED, FLAT OBJECTS

This application is a continuation of U.S. application Ser. No. 09/341,601, filed Sep. 17, 1999 now abandoned which is a 371 of PCT/CH98/00031 filed Jan. 28, 1998.

The method serves for cutting along predetermined cutting lines, flat objects being conveyed continuously and in parallel to their main surfaces whereby the cutting lines are parallel to the conveying direction. The method is particularly suitable for cutting flat objects which are difficult to be cut because they are e.g. easily deformable and/or consist of several possibly easily deformable layers which layers adhere to each other only slightly. Multi-page printed products made of relatively thin paper are an example for this kind of flat objects.

BACKGROUND

Flat objects are normally cut or trimmed in a direction perpendicular to their main surfaces. They are e.g. positioned between two straight cutting edges being positioned in a plane perpendicular to the main surfaces and being moved past each other and crossing each other such that the crossing point of the two cutting edges in which point cutting actually takes place moves along the predetermined cutting line across the main surfaces of the object to be cut. Hereby, one of the two cutting edges may lie in the plane of a surface supporting the object to be cut or be a part of this supporting surface. The other cutting edge is then moved relative to the supporting surface, either by being swiveled about an axis or in a movement perpendicular to the supporting surface. Thereby, the one cutting edge moving relative to the support surface is oriented at an angle to the support surface (cutting angle). This kind of cutting method is called cross cutting and is best known as shearing cut of stationary objects.

Devices for cross cutting flat objects being continuously conveyed perpendicular to their main surfaces are e.g. known from the publication EP-367715, devices for cutting flat objects being conveyed in parallel to their main surfaces e.g. from the publication U.S. Pat. No. 3,069,952 or from the publication EP-0698451. If cutting lines of objects being conveyed in parallel to the their main surfaces are perpendicular to the conveying direction the two cutting edges are arranged perpendicular to the conveying direction also. For such a cutting process, a finite time is needed and therefore, for achieving a high cutting precision it is obviously necessary to move the cutting device, at least during the cutting process, together with the object to be cut.

It shows that for cutting lines parallel to the conveying direction and conveyance in parallel to the main surfaces of the objects to be cut, a relative movement of the object to be cut and the cutting edges parallel to the conveying direction and friction forces created by such movement can have a negative effect on the cutting quality. This negative effect can be suppressed by pressing the objects to be cut against a support surface, at least during the cutting process. Such pressing e.g. prevents the object to be cut from being deformed by the relative movement and friction forces or if it consists of layers hardly adhering to each other the pressing prevents these layers from being shifted relative to each other and from such rendering the cut inaccurate.

According to publication EP-0698451, the attempt is made to prevent the above described relative movements between a continuously conveyed object and the cutting edges by moving at least one cutting edge together with the object to be cut in conveying direction. For cutting parallel to the conveying direction, flat objects conveyed in parallel to their main surfaces, this publication suggests to use two cutting blades with straight cutting edges facing each other and to move at least one of these blades with the help of two cranks, whereby a part of the thus created cyclic blade movement is exploited as cutting travel (perpendicular to the conveying direction) and as conveying travel (in conveying direction).

In the same publication it is postulated that the cutting quality achievable with the cutting device as described is best when the speed of the blade conveying travel is approximately the same as the conveying speed of the object to be cut, i.e. when during cutting, relative movements in conveying direction are prevented as far as possible. However, because of the conveying travel being created by the cranks changes sine-like the above condition can, if at all, only be fulfilled during a very short time. Therefore, either the cutting process must be restricted to a correspondingly short time, i.e. the cutting angle (angle between the two cutting edges involved in the cutting process) must be made very small, or a larger relative movement between the cutting edge and the object to be cut must be accepted, both of which facts restrict the application of the described device.

It is the object of the invention to create a method for cutting between two blades and along predetermined cutting lines, flat objects conveyed continuously and at a constant conveying speed substantially in parallel to their main surfaces, whereby a first cutting edge lies in the plane of a support or conveying surface of an object to be cut and the second cutting edge is moved past the first cutting edge and advantageously crosses it. The inventive cutting method is to enable sufficient to very high cutting qualities at low pressing forces by suitable guidance of at least the second cutting edge. In particular, the inventive cutting method is to make it possible to cut accurately and with a satisfying cutting quality objects which are difficult to be cut (e.g. objects which are easily deformable and/or consist of layers which adhere only slightly to each other) without the necessity of high pressing forces as needed in methods according to the state of the art and possibly having a negative effect on sensitive objects. All the same the cutting parameters, especially the cutting angle and the cutting speed are to be freely choosable within wide ranges, i.e. the method is to be simply adaptable to the most various applications.

Furthermore, it is the object of the invention to create a device for carrying out the method which device can be realized and operated with the most simple means.

SUMMARY OF THE INVENTION

The invention bases on the finding that it is possible to cut printed products consisting of a plurality of pages with satisfying to very high cutting quality although pressed onto a support surface with very slight pressure only or even without pressure, if in every moment of the cutting process at least the one point of the second cutting edge, which is involved in the cutting process (crossing point with the first cutting edge or cutting point), has a speed relative to the object to be cut which is directed as precisely perpendicular as possible to the support surface or to the first cutting edge or towards the main surfaces of the object to be cut respectively. This means that it is sufficient for only this cutting point of the second cutting edge to have an absolute speed having a component in conveying direction as precisely identical to the conveying speed as possible.

According to the inventive method, at least the second cutting edge which is moved towards the support surface is moved in a manner matched to the continuos conveying of the objects to be cut such that in each moment of the cutting process, at least the cutting point of this cutting edge has a speed of which the component in conveying direction is of the same size as the constant conveying speed. Due to this the friction forces in conveying direction mentioned further above, which friction forces have an accelerating or decelerating or in any case a destabilizing effect on the printed products to be cut, are prevented such that their effect does not have to be counteracted by pressing.

For the purpose of generalization it is stated that for the case in which the first cutting edge is arranged in the plane of the support surface as is suggested in the preceding paragraphs the products to be cut lie against this support surface and against the first cutting edge also due to gravity. Arrangements orientated differently in relation to gravity are thinkable. In such arrangements the named effect of gravity is to be taken over by suitable supporting means. These supporting means have the function of supporting the products such that they lie against the first cutting edge and advantageously against a support surface of which the first cutting edge is a part.

The desired movement of the second cutting edge past the first cutting edge and advantageously crossing the first cutting edge can be most easily realized by swiveling at a constant speed the second cutting edge about a rotation axis arranged above the support surface, whereby the rotation axis is perpendicular to the plane in which the two cutting edges are arranged and move. As will be shown further below the above condition can be fulfilled in this kind of arrangement by matching the distance between the rotation axis and the support surface and/or the rotation speed with the conveying speed. The cutting speed, i.e. the speed with which the cutting point moves on the main surfaces of the object to be cut, is dependent on the rotation speed and on the position of the swiveling second cutting edge in relation to the rotation axis. This position is freely selectable within a large range.

The inventive device for carrying out the embodiment of the inventive method described above comprises a pair of blades orientated in conveying direction each having a substantially straight cutting edge. The first cutting edge is arranged in the plane of the support surface of the object to be cut, the second cutting edge is swivelable or rotatable about a rotation axis positioned above the support surface. The second cutting edge is positioned in a plane perpendicular to the rotation axis. In an advantageous embodiment, a plurality of blades with second cutting edges are arranged on a uniformly rotating carrier.

Further embodiments of the inventive method comprise movement of the second cutting edge past the first cutting edge in a direction perpendicular to the support surface or in a rotation movement about a rotation axis lying in the plane of the support surface and simultaneous movement in conveying direction at a constant speed identical to the conveying speed. In such a case, again in every moment of the cutting process, not only the cutting point on the second cutting edge but the whole cutting edge has a speed relative to the object to be cut which is orientated precisely perpendicular to the support surface.

It shows that in many applications it is sufficient for the first cutting edge arranged in the plane of the support surface of the objects to be cut to be stationary. However, this cutting edge may be moved also such that there is as little relative movement as possible between the first cutting edge and the objects to be cut.

DESCRIPTION OF THE DRAWING

The inventive method and different, exemplified embodiments of the device for carrying out the method are described in more detail in connection with the following Figures, whereby.

DETAILED DESCRIPTION

Figure 1:
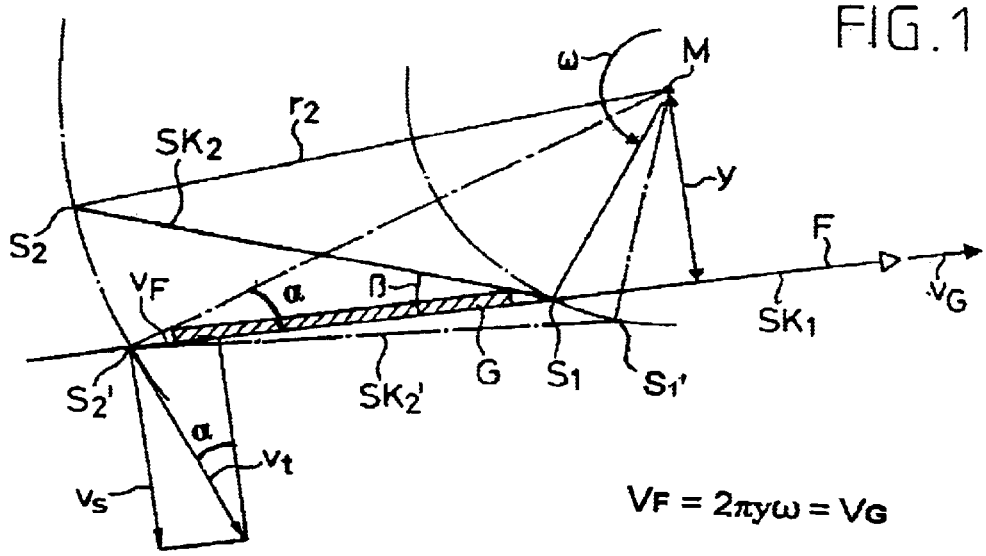
FIG. 1 shows the principle of a preferred embodiment of the inventive method.

FIG. 1 shows a simple diagram for illustrating a preferred embodiment of the inventive method. The Figure shows a line F with an arrow representing the conveying direction of the objects to be cut of which one is shown and denominated G. The line F simultaneously represents a section through the support or conveying surface and a first cutting edge $SK_1$ positioned in the plane of the support surface and in parallel to the conveying direction. The Figure further shows a second cutting edge $SK_2$ swivelable or rotatable around a stationary rotation axis M and in a plane perpendicular to the rotation axis M with a constant rotation speed $\omega$.

During rotation of the second cutting edge $SK_2$ from a first rotation position ($SK_2$ in unbroken lines) to a second rotation position ($SK_2'$ in broken lines), the second cutting edge crosses the first cutting edge, i.e. is in cutting operation together with the first cutting edge. In this kind of swiveling or rotation movement the point $S_1$ of the cutting edge $SK_2$ gets first involved in the cutting operation, i.e. represents the cutting point. Then the cutting point moves towards the left on both cutting edges. The cutting operation ends when the second cutting edge reaches the position $SK_2'$ and when point $S_2$ (position $S_2'$) is the cutting point on the second cutting edge.

It can easily be shown in this kind of arrangement that the speed component $v_F$ in conveying direction of the cutting point on the second cutting edge $SK_2$ is of the same size in every moment of the cutting process and that the size of this speed component VF is directly proportional to the product of the rotation speed $\omega$ and the distance y between the support surface or the first cutting edge $SK_1$ and the rotation axis M.

For point $S_2$ of the second cutting edge $SK_2$, when it is in the position $SK_2'$ ($S_2'$ is the cutting point of the second cuffing edge $SK_2$ in this position), the following is valid: tangential speed $v_t=2\pi r_2\cdot\omega$, speed component in conveying direction $v_p=v_t\cdot\sin\alpha=2\pi r_2\omega\cdot y/r_2=2\pi\omega\cdot y$.

The speed component $v_F$ in conveying direction is thus independent of the radius with which the cutting point moves about the rotation axis, i.e. it is constant during the whole cutting process as long as $\omega$ is constant. Furthermore, it is the same as the tangential speed of a point rotating at an angle speed $\omega$ and with a radius y about M.

From this it follows that the local speed component in conveying direction F of the second cutting edge $SK_2$ can for the cutting point be made the same as the conveying speed $v_G$, by choosing y and/or en such that the following condition is fulfilled:

$$y \cdot \omega = v_G / 2\pi$$

On cutting between the two cutting edges $SK_1$ and $SK_2$ an object being conveyed continuously in the conveying direction F at a constant conveying speed $v_G$ and with $v_G = v_F$ valid for the cutting point on the second cutting edge $SK_2$, there is in no moment of the cutting process a relative movement in conveying direction between the object and the second cutting edge $SK_2$. This is theoretically only correct if the object has no extension in the direction of y, i.e. if it has no thickness. It is approximately correct if the thickness of the object to be cut is small compared to the distance y.

Between two successive cutting processes, the cutting edge $SK_2$ must be brought back from its rotation position after cutting ($SK_2'$) into the initial position ($SK_2$). This can either be achieved by swiveling it in the opposite direction or by further rotation around the rotation axis M in the same direction. As it follows from the above explanations that the rotation speed ω for the cutting process must be constant, rotation of the second cutting edge is more advantageous as a constant angle speed is more easily achieved for a rotation than it is achieved for an alternating swivelling movement in opposite directions.

As will be shown further on, it is advantageous to arrange a plurality of identical second cutting edges rotating about the rotation axis M.

A cutting process according to FIG. 1 begins on the downstream edge of the object G and ends on its upstream edge. Theoretically, an object G can be cut apart in one single cutting process if its extension in conveying direction is not larger than the distance between the points $S_1$ and $S_2'$ plus the distance by which the object travels during the cutting process. The second cutting edge is advantageously designed such that its beginning and its end region are not used for cutting an object, i.e. that advantageously the distance $S_1$–$S_2'$ is designed such that it is rather larger than the extension in conveying direction of the object to be cut.

From FIG. 1 it can be seen that the cutting angle (angle between the two cutting edges involved in the cutting process) decreases during the cutting process, whereby the cutting speed decreases with rising initial cutting angle β. From the above derivation it follows that the cuffing angle β has no influence on the speed component $v_F$, i.e. that it can be chosen freely according to demands by the object of the invention. This is made yet clearer by FIGS. 2 to 5 in which arrangements are shown which correspond to the arrangement according to FIG. 1 excepting the initial cutting angle (β.1 to β.4). In each of the FIGS. 2 to 5 the rotation position of the second cutting edge $SK_2$ at the beginning of the cutting process and $SK_2'$ at the end of the cutting process are shown.

Stated differently, what may be seen is that the cutting point, defined as the point of intersection between cutting edges $SK_1$ and $SK_2$, moves in a way that is solely dependent upon the angular velocity ω and the distance y between the pivot axis M and the plane in which the work piece moves, and is wholly independent from many other parameters such as the angle β at which the cutting edges $SK_1$ and $SK_2$ intersect. It is thus within the ability of the designer of the apparatus to arrange for the velocity of the cutting point (defined as $V_F$) to match or very nearly match the velocity of the work piece (defined as $V_G$).

It will be appreciated that the cutting point, as defined above, moves in a way that is not the same as the motion of (for example) any particular part of the cutting edge $SK_2$.

Figure 2:
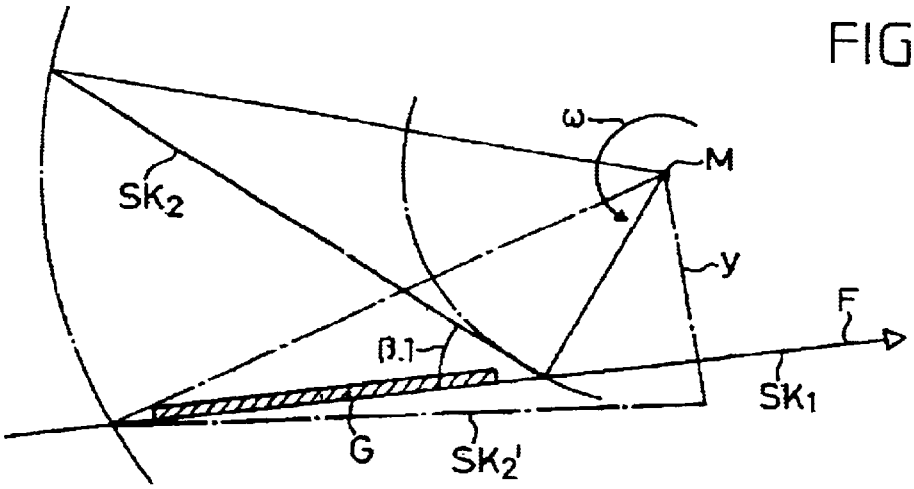
FIGS. 2 to 5 are further representations like FIG. 1 illustrating various cutting angles.

FIG. 2 shows a larger initial cutting angle β.1 than the initial cutting angle β in FIG. 1. Because the initial cutting angle β.1 opens away from the rotation axis as in FIG. 1 the object is cut beginning at its downstream edge, as in FIG. 1. Because the angle β.1 is larger than β (FIG. 1) the cutting speed is smaller.

Figure 3:
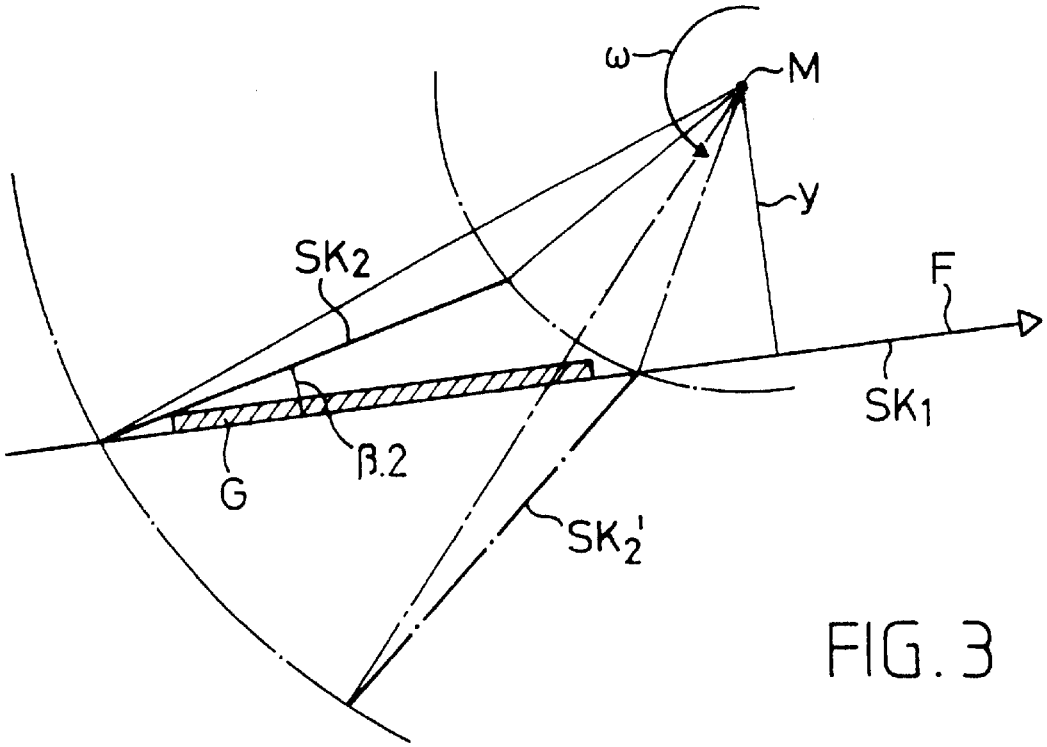

FIG. 3 shows an initial cutting angle β.2 which opens towards the rotation axis M and causes the cutting process to begin at the upstream edge of the object G. The speed conditions are identical to the ones in FIGS. 1 and 2.

Figure 4:
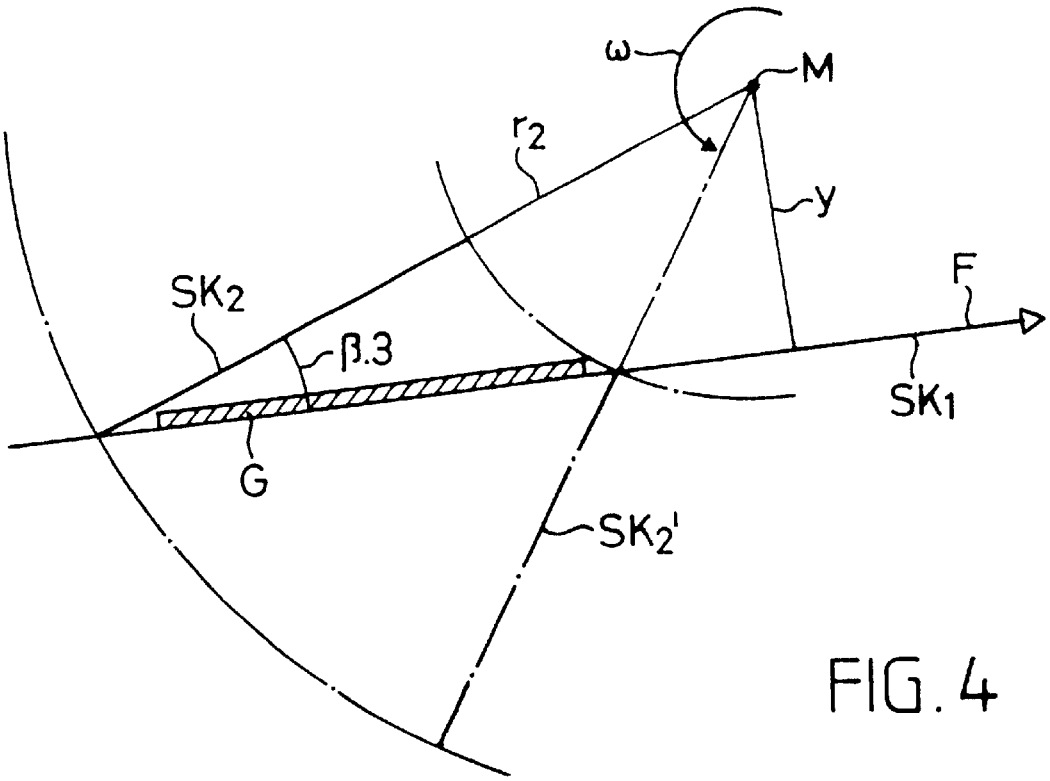

FIG. 4 shows, as a special case, a second cutting edge $SK_2$ which is arranged radially in relation to the rotation axis M. The initial cuffing angle β.3 opens, in this case also, towards the rotation axis M (the cuffing process begins at the upstream edge of the object G) and is identical to the angle having a sine ($\beta.3 = y/r_2$.

Figure 5:
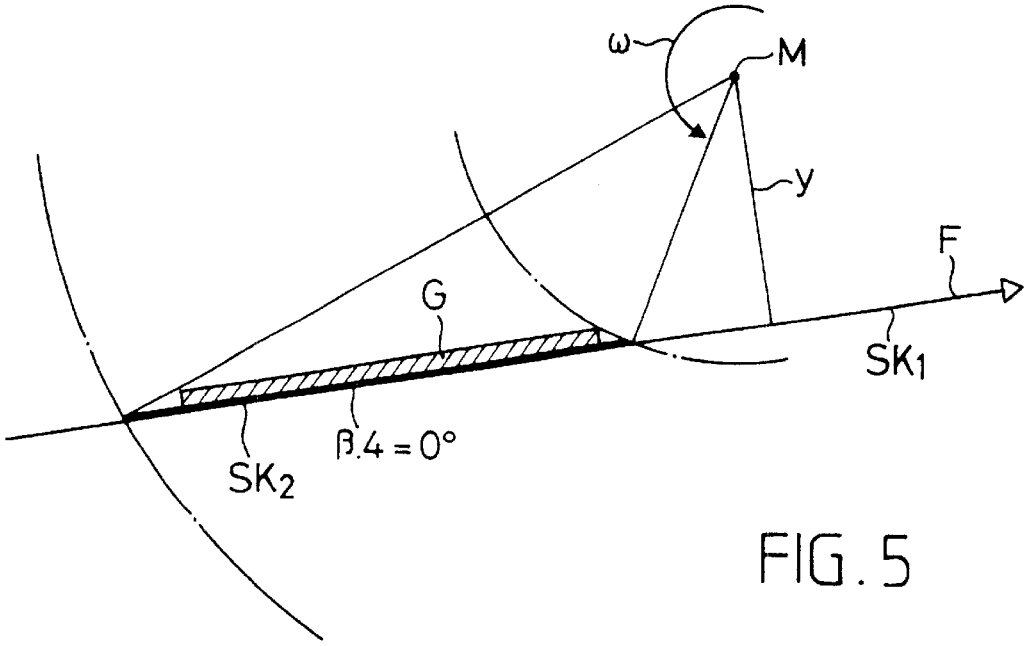

FIG. 5 shows, as an extreme case, an initial cutting angle β.4=0°, i.e. the case which is no longer a cross cut but is a full-edge-cut. The time which is necessary for this kind of cut is theoretically zero and practically only dependent on the thickness (extension in direction y) of the object G. In this kind of arrangement the condition of restriction of the relative speed to a component perpendicular to the main surfaces of an object G to be cut is still fulfilled with corresponding matching of rotation speed ω and distance y.

Figure 6:
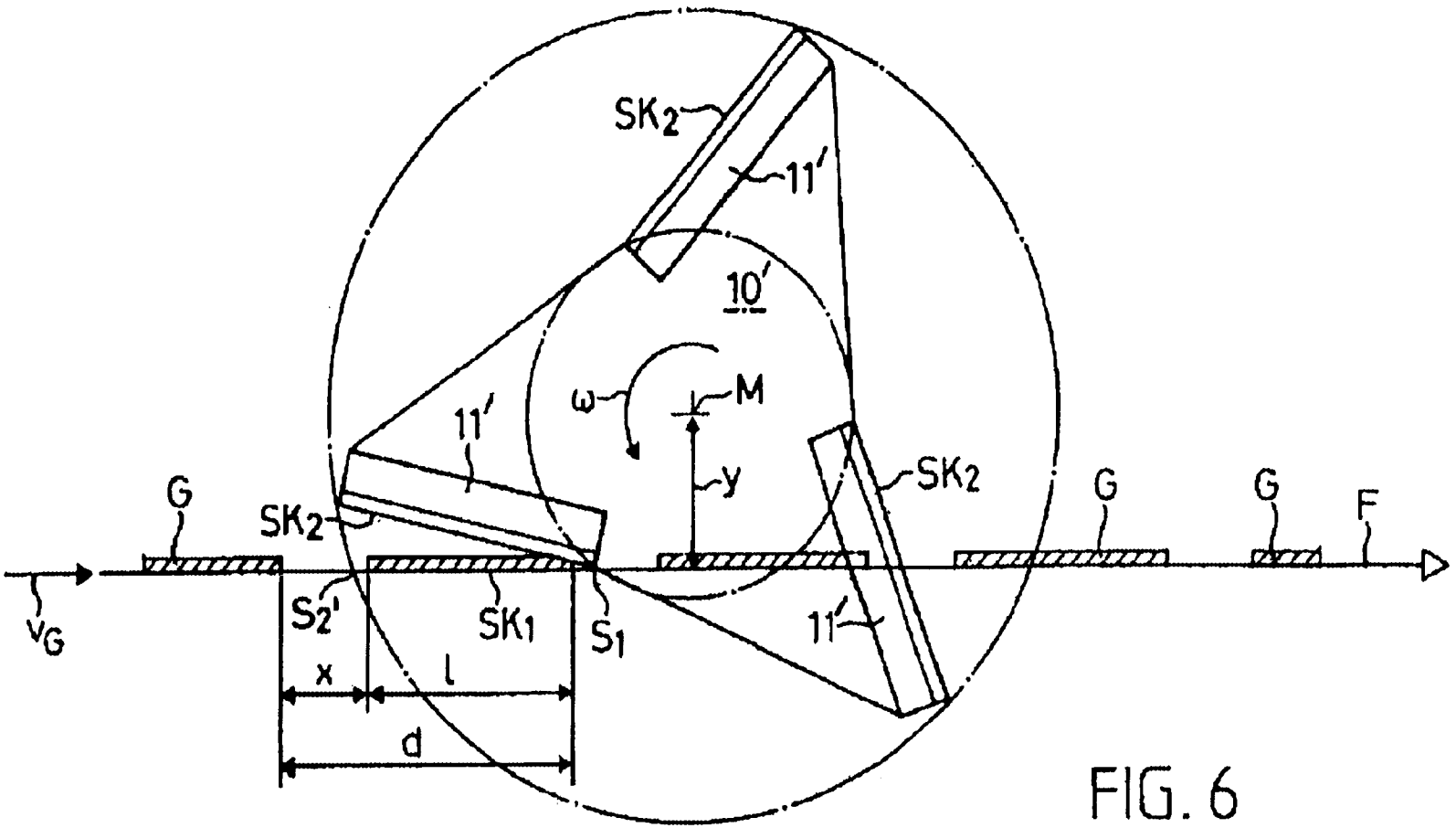

FIG. 6 shows an exemplified embodiment of the inventive device with a carrier 10' on which several blades 11' are arranged in star-shaped manner. The blades have second cutting edges $SK_2$ and the carrier is driven to rotate at a constant angle speed n about a rotation axis M arranged at a distance y above the support surface of the objects G to be cut or above the first cutting edge $SK_1$ respectively.

If objects G with an extension 1 in conveying direction and distances x between each other (distances d between downstream edges=1+x) are conveyed along the support surface in conveying direction F at a constant conveying speed $V_G$, the blades 11' are to be arranged such that the distance $S_1$–$S_2'$ is at least as large as 1 minus the distance by which an object is transported forwards during a cutting process (for short cutting times at least as large as 1). If n (e.g. three) second cutting edges are provided the blades lit must each be arranged with a displacement of 360°/n (e.g. 120°) around the center of the carrier 10. In order for one object to be cut with each cutting edge $SK_2$ the rotation speed m of the carrier must be adjusted such that in the same time in which the carrier rotates by 360°/u (e.g. 120°) the objects are moved forwards by a distance d. Thus it can be said for ω and y:

$$\omega = v_G / dn \text{ and } y = dn / 2\pi$$

In order for an object not to be transported into the cutting region of the two cutting edges $SK_1$ and $SK_2$ during the cutting of the preceeding object it must be seen to that, by means of corresponding choice of the cutting angle β that the cutting time is not larger than $x/v_G$ (time in which an object is moved forward by the distance x). For preventing the upstream edge of an object from being cut with the outermost region of the cutting edge $SK_2$ (point $S_2$ or $S_2'$ respectively) the size of x must be corrected correspondingly.

Figure 7:
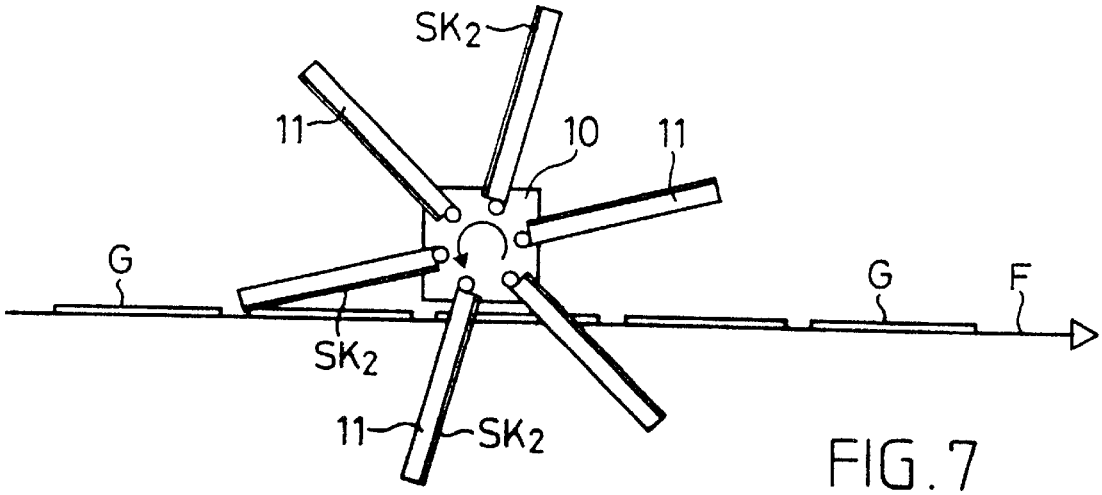
FIGS. 6 and 7 show two exemplified embodiments of the inventive device with rotating second cutting edges.

FIG. 7 shows, in a very diagrammatic manner, an exemplified embodiment of the inventive device with a rotating carrier 10 on which six blades 11 are arranged in star-shaped manner such that the objects G supplied in conveying direction F are cut starting from their upstream edges, as has previously been described in connection with FIGS. 3 and 4.

The FIGS. 6 and 7 show star-shaped carriers with three or six blades 11 or 11' with cutting edges $SK_2$. The number of blades 11 or 11' is to be matched to the blade arrangement (cutting angle) and to a simply realizable rotation speed range. As mentioned above in connection with FIG. 1, it is also possible to arrange only one blade with a second cutting edge on a corresponding rotating carrier.

Figure 8:
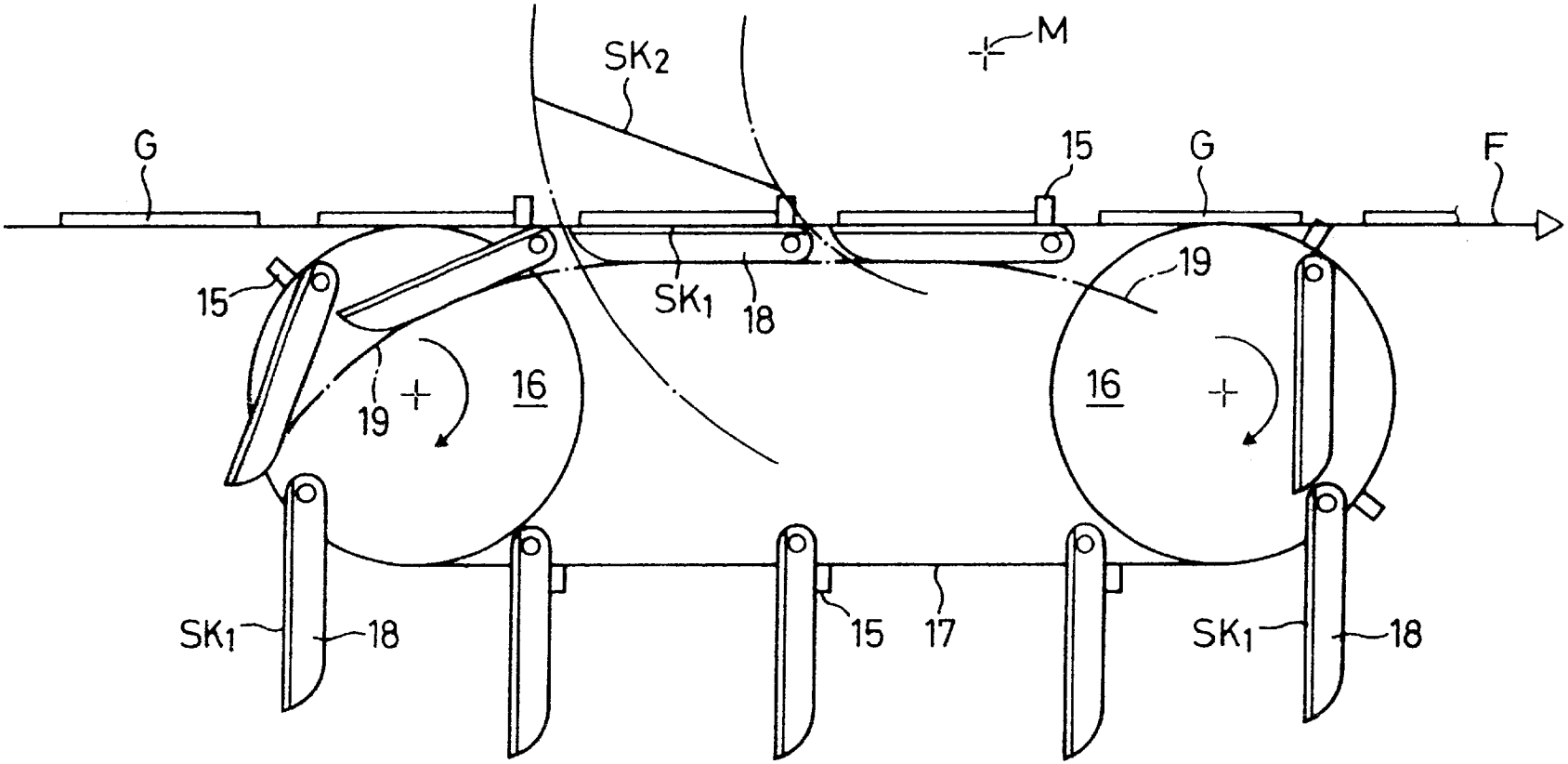
FIG. 8 shows an exemplified embodiment of the inventive device equipped for simultaneous movement of the first cutting edge.

As mentioned above, it may be advantageous for specific applications to also minimize a relative movement in conveying direction between the object to be cut and the first cutting edge arranged in the plane of the support surface of the objects to be cut. FIG. 8 shows two embodiments of inventive devices which are designed in this manner.

FIG. 8 shows, again by means of an arrowed line F, a conveying direction for objects G to be cut. The cutting region is shown diagrammatically by the rotation axis M and a rotatable second cutting edge $SK_2$.

Regarding the device, the arrow F e.g. represents a pair of conveying belts which are arranged in parallel and at a distance to each other and are driven in synchronism in the indicated direction. Between the conveying belts indicated by arrow F brake cams 15 are moved. These brake cams 15 are e.g. arranged on an endless chain 17 running over two deflection pulleys 16 and are moved such that they protrude over the support surface of the objects in the cutting region and move slightly slower in conveying direction than the pair of conveying belts. By means of these brake cams, the objects supplied on the conveying belts are slightly decelerated and are precisely clocked before they reach the cutting region.

E.g. on the same chain 17 there are arranged a plurality of blades 18 with first cutting edges $SK_1$. These blades are e.g. arranged on the chain in a pivotable manner and at a distance to the brake cams such that they are positionable laterally distanced from the conveying belts. A template 19 guides the blades 18 at least in the cutting region such that the first cutting edges $SK_1$ are positioned in the plane of the conveying belts (support surface for the objects to be cut). First cutting edges $SK_1$ arranged and moved in this manner have the same speed in conveying direction as the brake cams, i.e. also the same speed as the objects to be cut.

Instead of brake cams acting on the downstream edges of the products to be cut as shown in FIG. 8, acceleration cams acting on the upstream edges of the objects to be cut may be provided in an analogue manner and with the same function.

In an identical or similar manner in which, according to FIG. 8 blade 18 with the first cutting edge $SK_1$ is moved together with the brake cams 15 or the objects to be cut respectively, a whole scissors-shaped cutting device comprising two blades with first and second cutting edges pivotable in opposite direction around a rotation axis, can also be moved together with the objects to be cut. In order to fulfil the given condition regarding the relative speed of the second cutting edge to be restricted to a component perpendicular to the support surface, the rotation axis must be arranged in the plane of the support surface.

Figure 9:
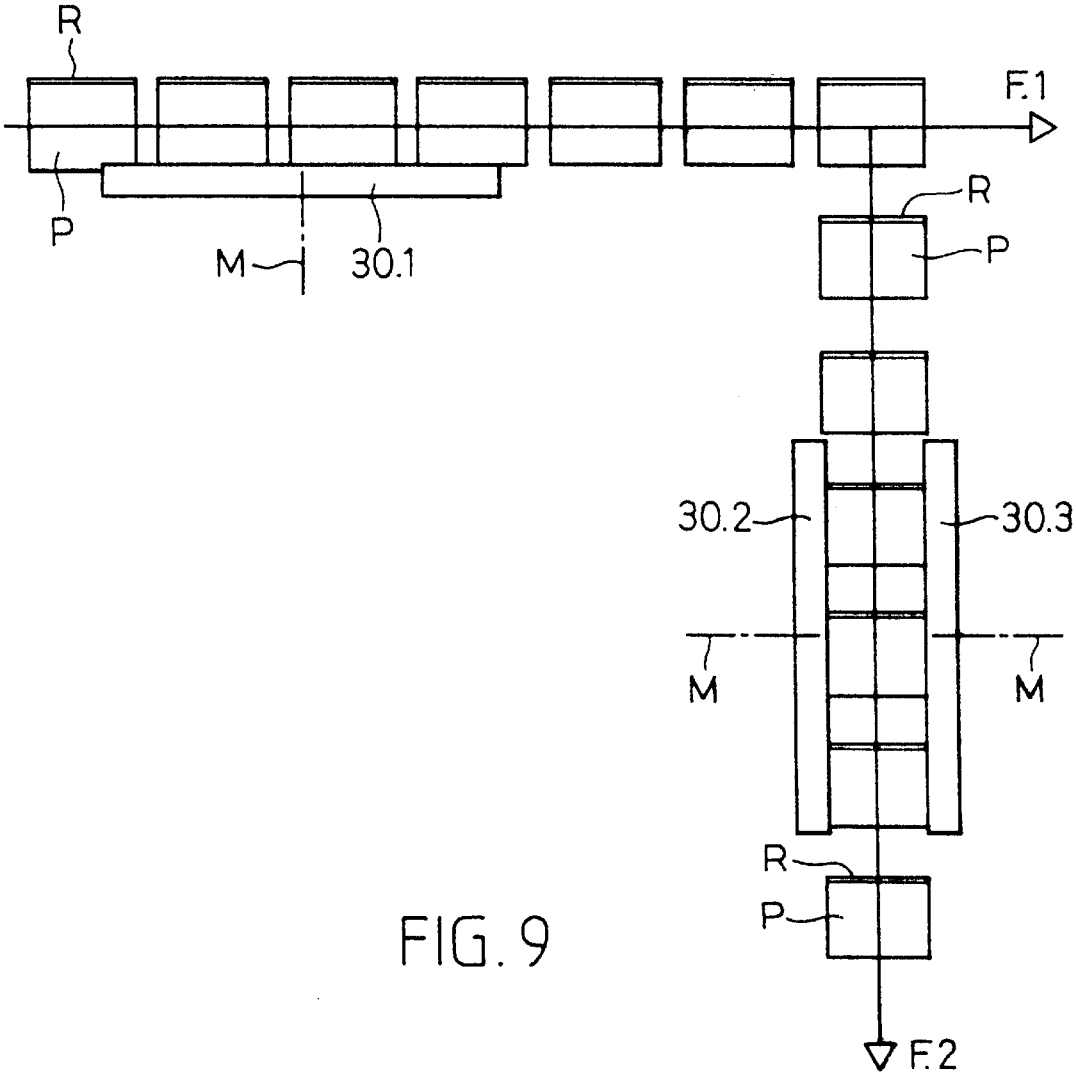
FIG. 9 shows an arrangement with three inventive devices for three-sided trimming of printed products e.g. magazines.

FIG. 9 shows, viewed from above, an arrangement with three inventive devices 30.1 to 30.3 for three-side trimming of printed products P with an e.g. bound, stitched or glued spine R. The printed products are conveyed in succession in a first conveying direction F.1 parallel to their spines R and their front edge opposite the spines R are trimmed with the help of the first cutting device 30.1. Then the printed products are deflected in a known manner without changing their spatial position such that they are conveyed further in a conveying direction F.2 perpendicular to their spines R. During this conveyance the top and bottom edges of the printed products are trimmed simultaneously by means of the cutting devices 30.2 and 30.3 arranged opposite to each other.

Figure 10:
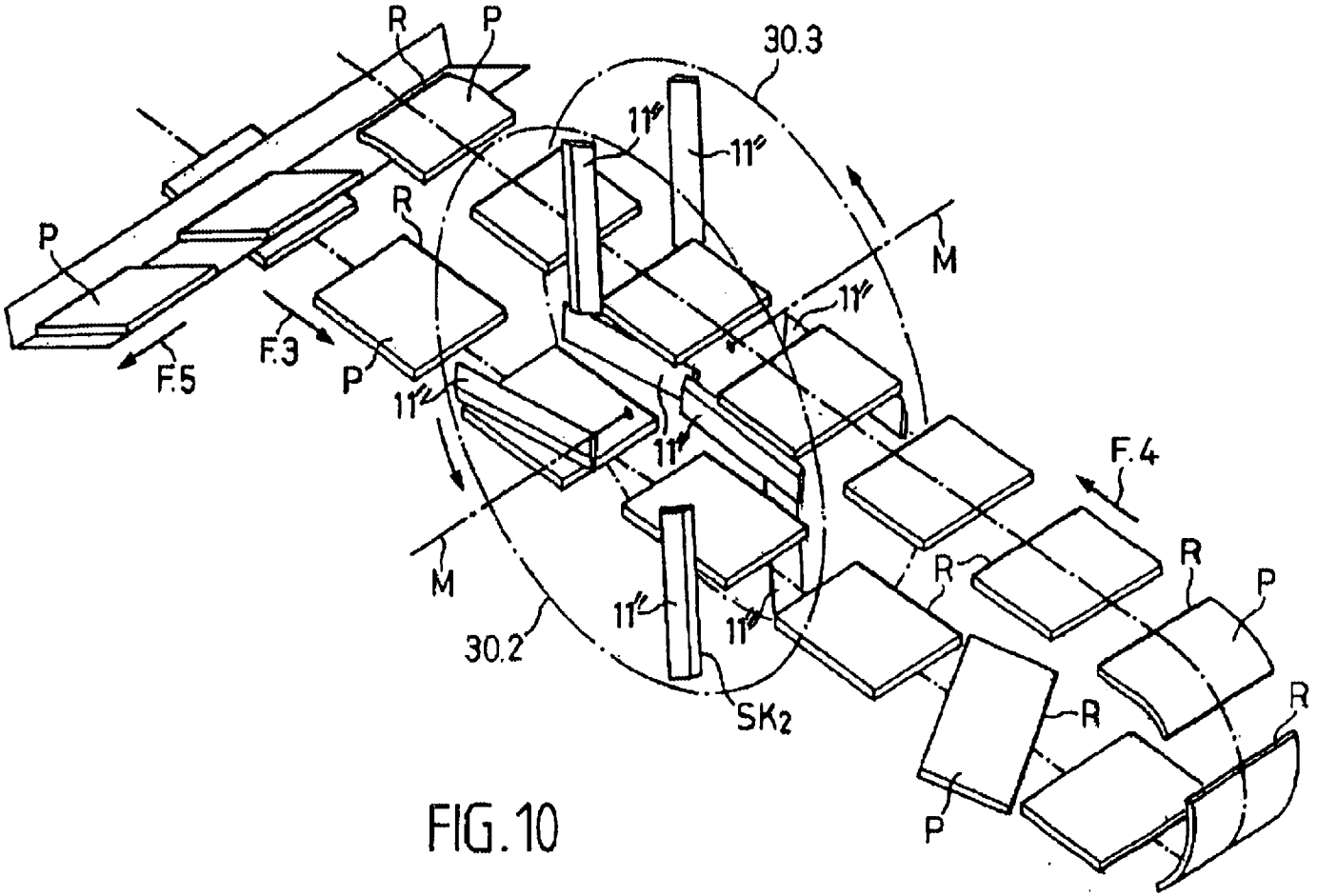
FIG. 10 shows a further arrangement for three-sided trimming of printed products e.g. magazines.

FIG. 10 shows, in a diagrammatic, three-dimensional representation, a further arrangement with which three edges of printed products P with spines R, e.g. magazines, are trimmed simultaneously by means of two simultaneously driven inventive devices 30.2 and 30.3 arranged opposite each other and in coaxial manner.

The two cutting devices 30.2 and 30.3 comprise each e.g. four blades 11" with second cutting edges $SK_2$ rotating about a rotation axis M.

The products P are conveyed in a supply direction F.3 to a position between the two devices 30.2 and 30.3, whereby the spines R of the products P are orientated parallel to the supply direction F.3. When passing between the two cutting devices the product edge parallel to the spine R is trimmed by one (30.2) of the cutting devices.

Then the products are rotated by 90° around their own axis such that the spine is perpendicular to the supply direction F.3 and the product stream is, by means of being deflected by 180°, turned back towards the devices 30.2 and 30.3 such that the products are conveyed, in a further conveying direction F.4, back between the two devices 30.2 and 30.3 e.g. with their spines orientated downstream. During this second passage between the devices 30.2 and 30.3 the two product edges perpendicular to the spine R are simultaneously trimmed by the two devices 30.2 and 30.3.

After the three-side trimming, the products, e.g. without changing their spatial position, are deflected by 90° and are conveyed away in a conveying-away direction F.5.

During their second passage through the double cutting device (30.2 and 30.3) the cutting arrangement is orientated the other way round in relation to gravity than in all previously described variants. This means that the first cutting edge (not shown in FIG. 10) is not arranged below the products P (in the plane of the support surface of the products) but above the products and that the second cutting edges $SK_1$ are not moved downwards in the cutting operation but upwards.

It is obvious that for this kind of arrangement, means must be provided for the products to be kept positioned against the first cutting edges, which function is taken over by gravity in the previously described embodiments.

In the arrangement shown in FIG. 10 it is e.g. imaginable to convey the products clamped between two belts, whereby for the first passage an outer belt and for the second passage an inner belt constitutes the support surface and whereby the first cutting edge is arranged in the region of the outer belt in both cases.

Inventive cutting devices are not only, as shown in FIGS. 9 and 10, applicable for trimming printed products but also for cutting printed products or other flat objects into two parts.

The inventive cutting method and the inventive device are not only applicable for cutting of individual objects which are conveyed in succession and at a distance from each other. They are also applicable for cutting lengthwise or for trimming lateral edges of scaled formations consisting of flat items conveyed in an overlapping manner or of quasi endless, continuously conveyed webs of material. For such applications, the condition for the distance x between the objects to be cut is not valid and the condition for the rotation speed ω is the following: n cutting lengths ($S_1$–$S_2$', FIG. 1) cannot be smaller than the travel of the material during one rotation of the carrier carrying a star-like arrangement of n blades with second cutting edges.

What is claimed is:

1. A method for cutting laminar objects having major faces during a continuous motion in a conveying direction with a conveying speed $V_G$, the conveying direction defining a downstream edge for each object and an upstream edge for each object, in which method the objects are cut along a cut line between first and second substantially linear cutting edges, the cut line substantially parallel to the conveying direction, the method defining a cutting process for each object, the method comprising:

positioning the first cutting edge close to one of the major faces of the objects;

rotating the second cutting edge about a pivot perpendicular to the conveying direction at a velocity ω and spaced away by a distance y from the major faces of the objects, the pivot defining a rotation axis, the rotation of the second cutting edge relative to the first cutting edge defining a crossing point where a cutting occurs, said crossing point further defining a region of the second cutting edge about the crossing point;

the rotation of the second cutting edge carried out so that $V_G = y\omega 2\pi$, whereby during the cutting, the region of the second cutting edge about the crossing point has a velocity, the velocity having a component in the conveying direction substantially the same as the conveying speed, and the cutting carried out so that each cut of an object is performed by only one second cutting edge;

the cutting carried out so that the conveying direction is parallel to the faces of the objects to be cut, and that the cutting edges are positioned or moving in a plane parallel to the conveying direction and substantially perpendicular to the faces of the objects.

2. The method of claim 1 wherein the conveying speed is substantially constant and wherein the rotation of the second cutting edge about the pivot is performed at substantially constant angular velocity.

3. A method of claim 1, characterized in that the first cutting edge is also moved with a speed having a speed component in conveying direction of the same size as the constant conveying speed.

4. The method of claim 1, characterized in that between two successive cutting operations, the cutting edge is swivel backwards or is rotated forwards about said rotation axis.

5. The method of claim 1, characterized in that a number of second cutting edges are arranged in a plane perpendicular to the rotation axis and at regular angular distances around said axis and that the arrangement of second cutting edges is rotated about the rotation axis such that the second cutting edges move past the first cutting edge in succession for successive cutting processes.

6. The method of claim 1, characterized in that, during the cutting process, the first and second cutting edge form a cutting angle opening away from the rotation axis such that the cutting process begins at the downstream edge of the object.

7. The method of claim 1, characterized in that, during the cutting process, the first and second cutting edge form a cutting angle opening towards the rotation axis such that the cutting process begins at the upstream edge of the object.

8. The method of claim 1, characterized in that, prior to the cutting process, the objects to be cut are acted upon by cams to assist in controlling the conveying speed of the objects.

9. The method of claim 1, characterized in that the successively conveyed laminar objects are printed products each having a spine, top and bottom edges and an edge opposite the spine, the printed products being conveyed in parallel to their spines in spatial relation to each other and that their edges opposite the spine are printed products are then deflected by 90 degrees without their spatial position being changed and that then their top and bottom edges are trimmed simultaneously.

10. The method of claim 1, wherein the laminar objects are printed products each having an axis perpendicular to the major faces, the printed products being conveyed individually and in succession, characterized in that two rotating carriers carrying blades with second cutting edges are arranged coaxially on a mutual rotation axis and are driven in synchronism and that the conveyed printed products are trimmed in a first and a second passage between the carriers, whereby between the two passages, the products are rotated by 90 degrees around their own axis and are deflected such that the first passage takes place on one side of the mutual rotation axis and the second passage on the opposite side of said rotation axis.

11. An apparatus for cutting laminar objects during continuous motion in a conveying direction, the objects having major faces, the apparatus comprising:

a conveyor conveying the laminar objects in a continuous motion in the conveying direction with a conveying speed $V_G$;

first and second substantially linear cutting edges, the objects being cut along a cut line between the first and second cutting edges;

the motion of the laminar objects substantially parallel to the cut line;

means positioning the first cutting edge close to one of the major faces of the objects;

means for rotating the second cutting edge about a pivot perpendicular to the conveying direction at a velocity ω and spaced away by a distance y from the major faces of the objects, the pivot defining a rotation axis, the rotation of the second cutting edge relative to the first cutting edge defining a crossing point where a cutting occurs, said crossing point further defining a region of the second cutting edge about the crossing point;

the rotating means further characterized in that the rotation of the second cutting edge is carried out so that $V_G = y\omega 2\pi$, whereby during the cutting, the region of the second cutting edge about the crossing point has a velocity, the velocity having a component in the conveying direction substantially the same as the conveying speed; and the length and positioning of the second cutting edge characterized in that each cut of an object is performed by only one second cutting edge;

the cutting carried out so that the conveying direction is parallel to the faces of the objects to be cut, and that the cutting edges are positioned or moving in a plane parallel to the conveying direction and substantially perpendicular to the faces of the objects.

12. The apparatus of claim 11, characterized in that a plurality of blades with second cutting edges are arranged on a carrier in a star-shaped arrangement in a plane perpendicular to the rotation axis, whereby the carrier is functionally connected to the rotating means.

13. The apparatus of claim 11, characterized in that a blade carrying the first cutting edge is arranged in the conveying direction and is movable at the conveying speed.

14. The apparatus of claim 11 wherein the conveying speed is substantially constant and wherein the rotation of the second cutting edge about the pivot is performed at substantially constant angular velocity.

* * * * *